United States Patent [19]

Czarny

[11] 4,339,120

[45] Jul. 13, 1982

[54] AMUSEMENT DEVICE FOR CREATING AN ILLUSION

[76] Inventor: Alex G. Czarny, 1055 W. Stanford Ave., Englewood, Colo. 80110

[21] Appl. No.: 186,575

[22] Filed: Sep. 12, 1980

[51] Int. Cl.[3] ..... A63J 5/00; A63J 21/00

[52] U.S. Cl. ..... 272/8 R; 224/919

[58] Field of Search ..... 272/8 R, 8 N, 9, 27 N; 124/37, 41 R; 224/919

[56] References Cited

U.S. PATENT DOCUMENTS

| | | | |
|---|---|---|---|
| 2,416,473 | 2/1947 | Fields | 272/8 R X |
| 2,498,298 | 2/1950 | Renz | 272/8 R |
| 3,801,094 | 4/1974 | Treaster | 272/8 R |
| 3,822,879 | 7/1974 | Guitar | 272/8 R |
| 4,042,156 | 8/1977 | Knight | 224/919 X |
| 4,095,783 | 6/1978 | Bailey | 272/8 R |

*Primary Examiner*—George J. Marlo

*Attorney, Agent, or Firm*—John E. Reilly

[57] ABSTRACT

A device for providing an illusion of a ball changing color as it travels through a cylinder assembly. The cylinder assembly includes an outer open-ended cylinder into which an inner tubular compartment divided by a baffle plate is positioned in sliding fit interrelationship. The cylinder has one or more yieldable retainer elements or clips adjacent the opposite ends of the cylinder to permit passage of a round object, such as a ball, from externally of the cylinder through the inner compartment. As the ball passes into the inner compartment and strikes the baffle plate, it simultaneously releases a second ball of another color in the bottom portion of the inner compartment and propels the second ball through the lower end of the cylinder. In this way, an illusionary effect of the ball having changed color in its course of travel is achieved.

13 Claims, 3 Drawing Figures

AMUSEMENT DEVICE FOR CREATING AN ILLUSION

This invention relates to an illusionary amusement device, and more particularly to a feed-through cylinder wherein an illusion is created that an object has changed in color.

BACKGROUND AND FIELD OF THE INVENTION

Various amusement devices for creating the effect of illusion have been devised in the past. In the field of entertainment, magicians perform tricks using apparatus and slight of hand to create illusion. In this field, such apparatus and devices are seen frequently; therefore there is a continuing need for new and stimulating devices to maintain an interest in this phase of entertainment. U.S. Pat. Nos. 2,498,298 to Renz and 3,822,879 to Guitar disclose coin trick apparatus. The Renz device is composed of a cylindrical shell and inverted case simulating a stack of coins wherein interposition of coins is accomplished to create the effect of disappearance and reappearance of a coin within the stack. The Guitar apparatus consists of a nesting arrangement giving the appearance of an annular coin and two solid coins when manipulated by a skilled performer. U.S. Pat. No. 4,095,783 to Bailey represents another illusionary device composed of a sliding panel arrangement wherein a collapsible midpanel seems to disappear. Others have proposed the use of various types of illusionary devices for entertainment purposes. In the past however there has been no apparatus devised wherein the effect of a ball or like object seemingly changes color when inserted in one end of a cylinder and discharged from the opposite end.

SUMMARY OF THE INVENTION

It is therefore an object of the present invention to provide for a novel and improved amusement device for creating an illusion.

It is another object of the present invention to provide an illusionary device wherein a ball is inserted into a cylinder thereby releasing a second ball of another color, creating the illusion of the first ball changing color.

It is still further object of the present invention to provide an open-ended color-changing cylinder for balls including spring retainers within its interior for respective retention and release of the balls.

A still further object of the present invention is to provide a cylinder having an inner compartment maintaining a sliding fit to retain a different colored ball in the bottom portion thereof until discharge is effected when a ball of a first color is dropped through the upper portion of the cylinder.

Yet another object of the present invention is to provide a device which permits an illusion having the disarming effect of tending to eliminate suspicion as to the possibility of use of two or more balls due to the construction and arrangement of the cylinder parts.

In accordance with the present invention, there is provided an illusionary device for amusement purposes including an open-ended cylindrical holder including radially inwardly projecting, spaced yieldable spring retainers positioned within its interior. An inner compartment is maintained in floating or sliding relation between axially spaced sets of retainers, one set of retainers releasably retaining a ball of one color in the bottom portion of the cylinder. When a ball of another color is inserted or dropped through the upper section of the cylinder, the other set of spring retainers release and allow the ball to slip downwardly, contacting a baffle and by force of momentum of the first ball, causing the inner concentric compartment to bear against the one set of retainers to permit the ball in the bottom portion to be released through the cylinder's lower end, thus revealing a ball of another color. In that way, an illusion is created that the first ball changed color during its downward course through the cylinder.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
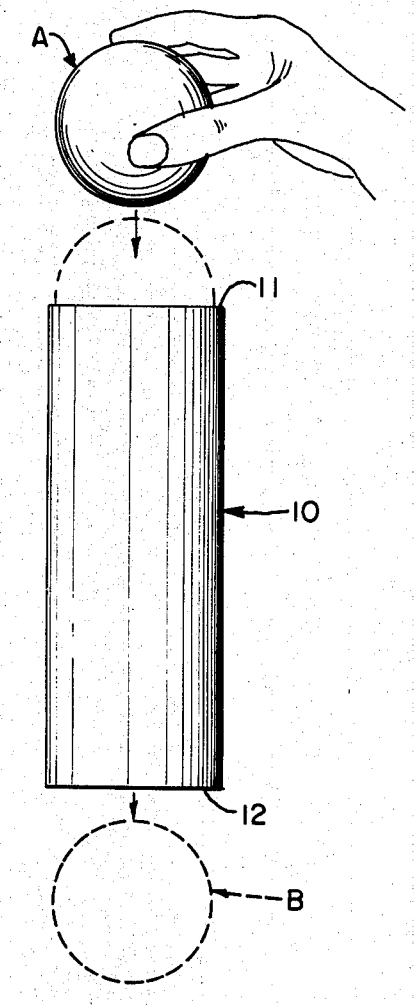
FIG. 1 is a diagrammatic view of an illusionary device embodying the present invention and illustrating the course of the respective objects therethrough.
Figure 3:
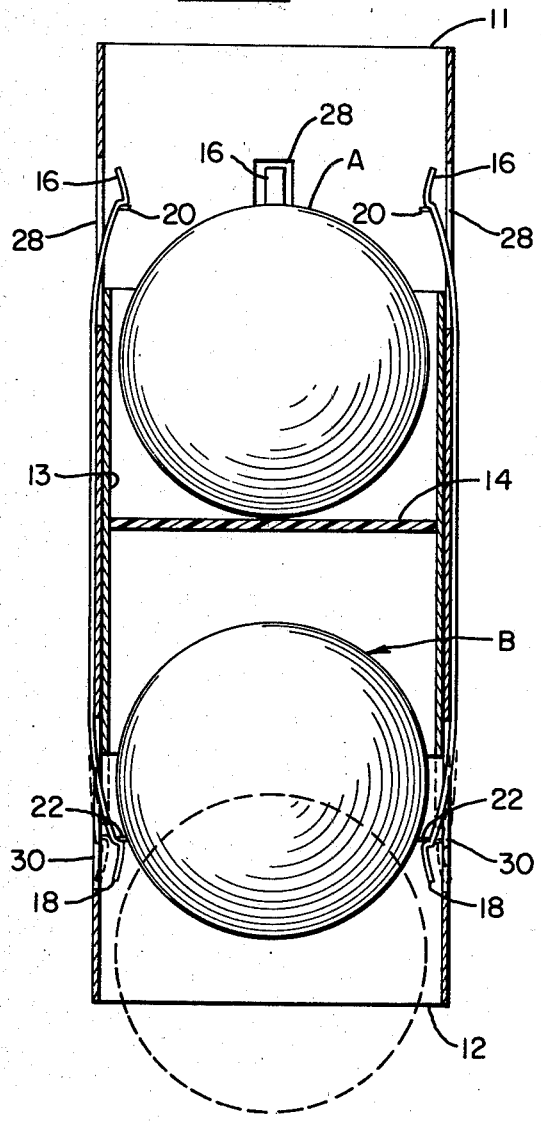
FIG. 3 is a side elevational view showing the device with its inner compartment and illustrating the insertion of the balls therein and their projected course of travel.

Referring in detail to the drawings, there is shown in FIGS. 1 and 3 a hollow tube or open-ended cylindrical holder 10, this view illustrating the course of a ball of one color A as it is dropped through the upper end 11 of cylinder 10 and the discharge of a ball of a different color B as it is discharged through the lower end 12 of the cylinder 10. Specifically referring to FIG. 3, an inner concentric cylinder or tubular compartment 13 is disposed in inner concentric relation to the outer cylinder 10 shown in FIG. 1. Prior to dropping ball A through upper end 11 of cylinder 10, ball B is inserted unobtrusively through the lower end 12 and releasably held in place by lower glaser points or shoulders 22. When ball A is inserted through the upper end 11, it passes through upper yieldable retainer or spring clips 16 into the inner compartment 13, coming into contact with baffle plate 14.

When ball A is inserted or dropped through the upper section 11 of the cylinder 10, one set of the three spring retainers 16 converge inwardly at a gradual angle toward the open end of the cylinder into a stepped portion or shoulder, as at 20, then diverge relatively sharply outwardly to permit ball A to be introduced through the open end 11 so that when ball A engages the outwardly divergent free ends of the spring clip 16, it will be sufficient to force the spring clip 16 outwardly and permit ball A to pass relatively easily through the cylinder 10 against baffle plate 14. In the reverse direction, another ball B is lodged between the spring clips 18 and baffle plate 14 and, by resting against the shoulder portions as at 22, are retained by the spring clips 18 until the clips 18 are pressed outwardly by the end of the inner tube or cylinder 13 when ball A is dropped through from the upper end 10. Baffle plate 14 is constructed of a transparent material, such as plexiglas, to present the appearance of a hollow tube. In the form of invention shown, there are sets of three upper retainer clips 16 and three lower retainer clips 18, the clips in each set being arranged in equally spaced circumferential relation to one another. Manufacture of the device is simplified by forming the clips in aligned relation to one another so that an upper and lower clip of each set is disposed at opposite ends of a common elongated strip 32 which extends lengthwise along the wall of the cylinder and has its opposite ends bent inwardly through upper and lower aligned slots 28 and 30, respectively, in the wall of the cylinder. Of course the retainer clips may be individually formed if desired and soldered directly to the inner wall of the cylinder to function in the manner described.

Should the cylinder 10 be reversed or tipped over prior to or after insertion of ball A, the shoulders of glaser points 20 and 22, respectively, will prevent balls A and B from inadvertent discharge through either of ends 11 or 12.

Figure 2:
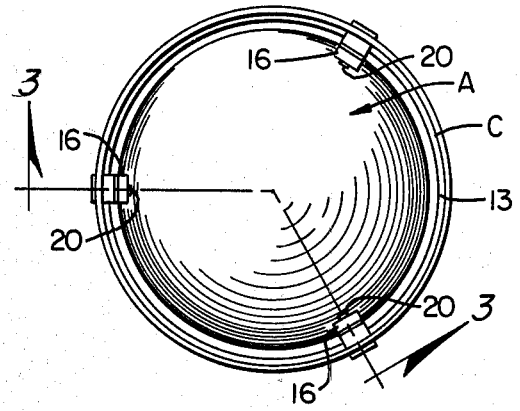
FIG. 2 is a cross-sectional view taken along lines 3—3 of FIG. 1.

Referring to FIG. 2, the relationship of the sliding fit arrangement C together with the yieldable retainer clips 16 in conjunction with glaser points 20 will be seen. As ball A is dropped through the upper end 11 of cylinder 10, the yieldable retainer clips 16 are urged slightly outwardly, allowing ball A to pass and engage baffle plate 14 and, by force of momentum, cause inner compartment 13 to move downwardly against retainers 18 so as to release ball B for discharge through the lower end 12 of the cylinder. Here it should be noted that balls A and B are used more for illustration and not limitation and that similar objects could be advanced through the assembly to release the retainer clip mechanism. A plurality of different colored balls could conceivably be employed together with a succession of spring release means at longitudinally spaced intervals throughout the cylinder assembly to accomplish a series of color-changing illusions.

From the foregoing, it will be seen that the device as described not only provides a new and stimulating amusement device but produces an illusionary effect of a type not heretofore devised. It is therefore to be understood that various modifications and changes may be made in the construction and arrangement of parts comprising the present invention as well as their intended application without departing from the spirit and scope of the present invention as defined by the appended claims.

I claim:

1. An illusionary device comprising in combination:

an open-ended, generally cylindrical holder having radially inwardly projecting, axially spaced yieldable retainers on the inner wall of said holder;

an inner concentric cylinder slidably disposed within said holder and constrained for axial movement between said axially spaced yieldable retainers, said inner concentric cylinder having a baffle member projecting radially inwardly therefrom;

first means releasably retained between one of said retainers and said baffle member; and second means operative when advanced through one end of said holder on one side of said baffle member opposite to said first means to engage said baffle member with sufficient momentum to cause said inner concentric cylinder to be driven against said one retainer so as to urge said one retainer away from engagement with said first means whereby to permit release of said first means from said holder.

2. An illusionary device according to claim 1, said axially spaced retainers being disposed adjacent to opposite ends of said holder.

3. An illusionary device according to claim 1, said yieldable retainers being in the form of spring elements having stop means thereon to normally prevent release of said respective first and second means from said holder.

4. An illusionary device according to claim 1, said first and second means being defined by balls of different colors.

5. An illusionary device according to claim 3, each of said spring elements converging along a low gradual angle from the inner wall of said holder toward one open end of said holder and terminating in a stop element.

6. An illusionary device according to claim 5, each of said spring elements being generally V-shaped in cross-section and having a stop element at the apex of said V.

7. An illusionary device according to claim 1, said yieldable retainers being further characterized by a plurality of retainers in axially spaced relation to one another adjacent to opposite ends of said holder, said retainers at each end of said holder being disposed in circumferentially spaced relation to one another.

8. An illusionary device according to claim 1, wherein said inner cylinder is in the form of a tubular member disposed in slidable relation within said holder.

9. An illusionary device according to claim 1, wherein said baffle member is defined by a plate extending transversely across and intermediately between opposite ends of said inner concentric cylinder.

10. A device for creating the illusion of color-change comprising in combination:

a cylindrical tube open at both ends with axially spaced yieldable retainers in the form of spring elements having stop means thereon gradually converging from the inner wall of the tube toward one open end of said tube and disposed adjacent to opposite ends of said tube;

an inner concentric cylinder slidably disposed within said tube and constrained for axial movement between said yieldable retainers, said inner concentric cylinder having a baffle plate extending across and intermediately between opposite ends of said inner concentric cylinder;

first object means of one color releasably retained by one of said retainers; and second object means of a second color operative when advanced through one end of said tube on one side of said baffle plate opposite to said first means to engage said baffle plate with sufficient force to cause said inner concentric cylinder to advance against said one retainer so as to urge said one retainer away from engagement with said first object means whereby to permit release of said first object means from said tube.

11. A device according to claim 10, said axially spaced yieldable retainers being further characterized by a plurality of retainers in axially spaced relation to one another adjacent to opposite ends of said tube, the retainers at each end of said tube being disposed in circumferentially spaced relation to one another.

12. A device according to claim 10, said first and second object means being defined by balls of different colors.

13. An illusionary device comprising in combination:

an open-ended, generally cylindrical holder (10) having radially inwardly projecting, spaced yieldable retainers (16, 18) in axially spaced relation to one another on the inner wall of said holder;

an inner concentric cylinder (13) slidably disposed within said holder (10) for axial movement between said yieldable retainers (16, 18), said inner concentric cylinder (13) having a baffle member (14) projecting radially inwardly therefrom;

first means (B) releasably retained by one of said retainers (18); and second means (A) releasably retained by the other of said retainers (16), one of said first and second means operative when advanced through an end of said holder (10) opposite to the other of said means to engage said baffle member (14) with sufficient momentum to cause said inner concentric cylinder (13) to be driven against one of said retainers so as to urge said one retainer away from engagement with said the other of said first and second means whereby to permit release of said other of said first and second means from said holder (10).

* * * * *